US008011823B2

(12) United States Patent
Suzuki

(10) Patent No.: US 8,011,823 B2
(45) Date of Patent: Sep. 6, 2011

(54) CLAY KNEADER

(75) Inventor: Hidetoshi Suzuki, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 138 days.

(21) Appl. No.: 12/483,021

(22) Filed: Jun. 11, 2009

(65) Prior Publication Data

US 2009/0245014 A1 Oct. 1, 2009

Related U.S. Application Data

(63) Continuation of application No. PCT/JP2008/052527, filed on Feb. 15, 2008.

(30) Foreign Application Priority Data

Mar. 1, 2007 (JP) ..... 2007-052109

(51) Int. Cl.
*B28C 7/16* (2006.01)

(52) U.S. Cl. ..... 366/77; 366/88; 366/89

(58) Field of Classification Search ..... 366/88, 366/89, 76.93, 77
See application file for complete search history.

(56) References Cited

U.S. PATENT DOCUMENTS

| | | | | |
|---|---|---|---|---|
| 6,513,963 | B2 * | 2/2003 | Derezinski | 366/89 |
| 2004/0062827 | A1 | 4/2004 | Yamaguchi et al. | |
| 2005/0073906 | A1 | 4/2005 | Hayashi | |
| 2009/0245014 | A1 * | 10/2009 | Suzuki | 366/76.93 |

FOREIGN PATENT DOCUMENTS

| | | |
|---|---|---|
| CN | 1493441 A | 5/2004 |
| JP | A 60-204302 | 10/1985 |
| JP | A 6-47793 | 2/1994 |
| JP | A 9-94818 | 4/1997 |
| JP | A 10-100131 | 4/1998 |
| JP | A 2005-66946 | 3/2005 |
| JP | A 2006-224563 | 8/2006 |

* cited by examiner

*Primary Examiner* — Tony G Soohoo
(74) *Attorney, Agent, or Firm* — Oliff & Berridge, PLC

(57) ABSTRACT

A clay kneader has a drum having a pressure raising section on a supply opening side, an extrusion section having an inner diameter smaller than that of the pressure raising section on side of an extrusion opening for extruding clay as a columnar article, and a flow controlling section located between the pressure raising section and the extrusion section and being equipped with a supply opening for clay, a screw having a rotary shaft having a diameter which gradually decreases toward the extrusion opening in the flow controlling section and being ended around a boundary between the flow controlling section and the extrusion section, and a helical rotating blade provided along the rotary shaft for kneading the clay a rotary shaft.

2 Claims, 7 Drawing Sheets

CLAY KNEADER

This is a Continuation of International Application No. PCT/JP2008/052527 filed Feb. 15, 2008, which claims the benefit of Japanese Application No, 2007052109 filed Mar. 1, 2007. The disclosure of the prior applications is hereby incorporated by reference herein in its entirety.

TECHNICAL FIELD

The present invention relates to a clay kneader which is preferably used in manufacturing, for example, a columnar article including a ceramic material or the like. More particularly, it relates to a clay kneader which decreases curvature occurring in the direction of extrusion of a flow pattern of a clay density generated in the clay kneader and which provides a satisfactory columnar article having highly uniform quality.

BACKGROUND ART

Heretofore, there have been known various constitutions of clay kneaders for use in kneading and homogenizing a clay including, for example, a ceramic material by the rotation of a screw in a drum to prepare a columnar article (e.g., see Patent Documents 1 and 2).

FIG. 2 is a schematic constitution diagram showing one example of a conventional clay kneader. As shown in FIG. 2, the conventional clay kneader has a structure in which a drum 2 is provided with a screw 4 therein. The screw 4 disposed in the drum 2 imparts a large shear force to the clay which flows from a supply opening 19 into the drum 2, to knead and homogenize the clay. Then, the clay kneaded and homogenized in the drum 2 is extruded to manufacture a columnar article 15.

Moreover, as a method of manufacturing a formed ceramic honeycomb article, a method is known which blends a ceramic material, water, a binder and the like, then prepares a kneaded clay as a large clay-like lump by a kneader, homogenizes the clay by deaeration and kneading by use of a clay kneader, simultaneously extrudes the clay to prepare the columnar article, and extrusion-forms (by a plunger type forming machine) this columnar article to manufacture the formed ceramic honeycomb article.

In this case, the columnar article is prepared by the clay kneader, and a flow pattern of a clay density is sometimes partially formed by the rotation of the screw of the clay kneader. Moreover, this flow pattern sometimes noticeably curves in an extrusion direction, depending on the structure of the distal end of the clay kneader. When a ceramic honeycomb structure is extrusion-formed by using such a columnar article, various formed article defects are generated. Examples of the defects include a screw-trace-like internal defect. Moreover, this defect is remarkably generated, when a larger amount of a pore former is contained.

Especially in recent years, the thinning of partition walls in the ceramic honeycomb structure has further progressed. To prepare the ceramic columnar article for use in the formed article having these thin walls, uniform quality is remarkably intensely demanded, and manufacturing steps of the columnar article need to be contrived so as to satisfy strict quality control requirements.

Patent Document 1: JP-A-9-94818

Patent Document 2: JP-A-10-100131

When the ceramic honeycomb structure or the like is extrusion-formed by using the columnar article obtained by the conventional clay kneader having the structure shown in FIG. 2, the flow pattern of clay density is generated in the columnar article with the rotation of the screw in the clay kneader. When this flow pattern noticeably curves in the extrusion direction and the honeycomb structure is formed by using this columnar article, a forming failure is sometimes generated.

FIG. 3 is a schematic explanatory view showing one example of a conventional clay kneader 30. In the screw structure of the conventional clay kneader shown in FIG. 3, an impulsive force is imparted to a clay while kneading the clay in a pressure raising section 10, to extrusion-form the columnar article through an extrusion section 12. At this time, the inner diameters of the pressure raising section 10 and the extrusion section 12 hardly change, and hence the flow pattern hardly curves in an extrusion direction 41. If the flow pattern curves, such curvature has little influence, and hence the forming failure is hardly seen in a case where the honeycomb structure is formed by using this columnar article.

However, as shown in the schematic explanatory view of FIG. 4 showing another example of the conventional clay kneader 30 and the schematic sectional view of FIG. 6 showing a distal end structure of the conventional clay kneader, in a case where an extrusion opening 10 is provided in such a region that the inner diameter of the extrusion opening is smaller than that of a pressure raising section 10 and as one example, the inner diameter is decreased from 45 cm to 30 cm with a decrease width of 15 cm, that is, a decrease ratio of about 67%, the flow pattern noticeably curves on the extrusion opening 41 side in a portion where the inner diameter of an extrusion section 12 decreases in the extrusion section 12. This conventional clay kneader 30 is sometimes used for a purpose of increasing the amount of the clay to be treated per unit time without changing the diameter of the columnar article. This is because as the inner diameter of the pressure raising section 10 is large, capability for treating the clay can be improved.

FIG. 8 is a schematic sectional view showing the side surface of the columnar article 15 obtained by using the conventional clay kneader 30 of FIG. 4. As shown in this drawing, flow patterns 17 are formed owing to a density difference in the clay so that the patterns are symmetric with respect to a rotary center line 16 of the columnar article 15 and noticeably curve in the extrusion direction 41. When the honeycomb structure or the like is formed by using the columnar article having these flow patterns 17, the above problems occur.

DISCLOSURE OF THE INVENTION

The present invention has been developed in view of the above conventional problem, and an object thereof is to provide a clay kneader which decreases curvature occurring in the direction of extrusion of a flow pattern of clay density generated in a drum with the rotation of a screw in the clay kneader and which provides a satisfactory columnar article having highly uniform quality and suitable for use in forming a honeycomb structure or the like.

As a result of intensive investigation for solving the above problem, the present inventor has found that the following constitution is adopted to achieve the above object, and has completed the present invention. That is, the present invention is as follows.

[1] A clay kneader comprising a drum including: a supply opening through which a clay including a ceramic material flows into a clay kneader, a screw having a rotary shaft and a helical rotating blade provided along the rotary shaft and configured to knead clay which has flowed into the clay kneader by the rotation of the rotating blade, and an extrusion opening from which clay is extruded as a columnar article, wherein the drum includes a pressure raising section on the side of the supply opening, an extrusion section having an inner diameter smaller than that of the pressure raising section on the side of the extrusion opening, and a flow controlling section located between the pressure raising section and the extrusion section, the inner diameter of the flow controlling section is equal to that of the end of the pressure raising section on the extrusion opening side in the end of the flow controlling section on the supply opening side, gradually decreases toward the extrusion opening, and is equal to that of the end of the extrusion section on the supply opening side in the end of the flow controlling section on the extrusion opening side, the rotary shaft has a diameter which gradually decreases toward the extrusion opening in the flow controlling section, and includes a rotary shaft end section around a boundary between the flow controlling section and the extrusion section, and the rotating blade is formed from at least the inside of the pressure raising section to the vicinity of the rotary shaft end section.

[2] The clay kneader according to the above [1], wherein the length of the flow controlling section in the direction of the center line of the rotary shaft is in a range of 30 to 45 cm.

[3] The clay kneader according to the above [1] or [2], wherein the ratio of the diameter of an inner wall of the flow controlling section in the end thereof on the extrusion opening side with respect to the diameter of the inner wall of the flow controlling section in the end thereof on the supply opening side is in a range of 60 to 75%.

[4] The clay kneader according to any one of the above [1] to [3], wherein each of the fluctuation of the angle of a tapered portion of the distal end of the rotary shaft and the fluctuation of the angle of an outer peripheral portion of the rotating blade based on the angle of the inner wall of the flow controlling section with respect to the rotary shaft center line direction in the flow controlling section is in a range of 0 to 10°.

According to the constitution of the above [1], the clay kneader includes the flow controlling section whose inner diameter is equal to that of the end of the pressure raising section on the extrusion opening side in the end of the flow controlling section on the supply opening side and in which the rotary shaft gradually tapers toward the extrusion opening, but the rotating blade is formed from at least the inside of the pressure raising section to the vicinity of the rotary shaft end section, whereby the rotating blade keeps such an impulsive force as to extrude the clay even in the flow controlling section. Therefore, in a case where the columnar article having a desired diameter is formed, even when the inner diameter of the drum on the supply opening side is different from that of the drum on the extrusion opening side, the curvature of the flow pattern in the extrusion direction in the columnar article can be suppressed as much as possible.

According to the constitution of the above [2], since the length of the flow controlling section in the direction of the center line of the rotary shaft is in a range of 30 to 45 cm, the columnar article having the desired diameter can be obtained while suppressing the curvature of the flow pattern in the extrusion direction in the flow controlling section.

According to the constitution of the above [3], since the ratio of the diameter of the inner wall of the flow controlling section in the end thereof on the extrusion opening side with respect to the diameter of the inner wall of the flow controlling section in the end thereof on the supply opening side is in a range of 60 to 75%, the columnar article having the desired diameter can be obtained while suppressing the curvature of the flow pattern in the extrusion direction in the flow controlling section.

According to the constitution of the above [4], since each of the fluctuation of the angle of the tapered portion of the distal end of the rotary shaft and the fluctuation of the angle of the outer peripheral portion of the rotating blade based on the angle of the inner wall of the flow controlling section with respect to the rotary shaft center line direction in the flow controlling section is in a range of 0 to 10°, the columnar article having the desired diameter can be obtained while suppressing the curvature of the flow pattern in the extrusion direction in the flow controlling section.

According to the clay kneader of the present invention, the curvature caused by the change of the inner diameter of the flow pattern of the clay in the clay kneader generated by the rotation of the rotating blade can be suppressed, and the satisfactory columnar article having highly uniform quality is obtained. Moreover, in a case where a ceramic honeycomb structure is extrusion-formed by using the columnar article, the ceramic honeycomb structure which does not have any defect can easily be manufactured.

DESCRIPTION OF REFERENCE NUMERALS

2: drum, 4: screw, 5: rotating blade, 6: rotary shaft, 7: rotary shaft end section, 8: clay kneader distal end structure, 9: rotary shaft center line, 10: pressure raising section, 11: flow controlling section, 12: extrusion section, 15: columnar article, 16: columnar article center line, 17: flow pattern, 18: columnar article diameter direction, 19: supply opening, 20: extrusion opening, 30: clay kneader, 41: extrusion direction, 42: rotary shaft diameter direction, 43: flow controlling section inner wall, 51: rotary shaft distal end tapered portion, 52: rotating blade outer peripheral portion.

BEST MODE FOR CARRYING OUT THE INVENTION

Hereinafter, an embodiment of the present invention will be described, but needless to say, the present invention is not limited to the following embodiment.

Figure 1:
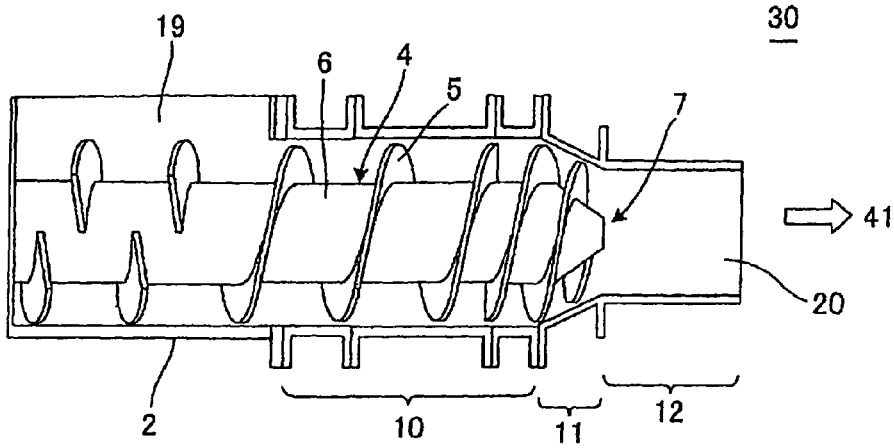
FIG. 1 is a schematic constitution diagram showing a clay kneader of the present invention.
Figure 2:
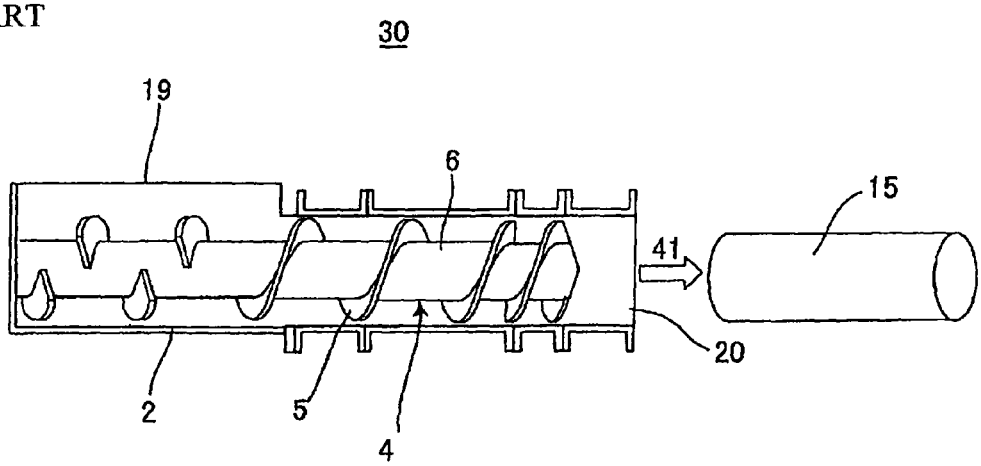
FIG. 2 PRIOR ART
FIG. 2 is a schematic constitution diagram showing a conventional clay kneader.
Figure 3:
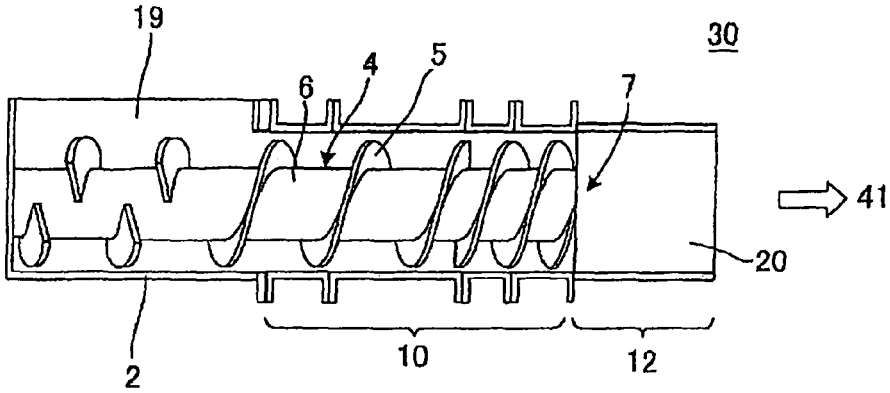
FIG.3 PRIOR ART
FIG. 3 is a schematic constitution diagram showing one example of the conventional clay kneader.
Figure 4:
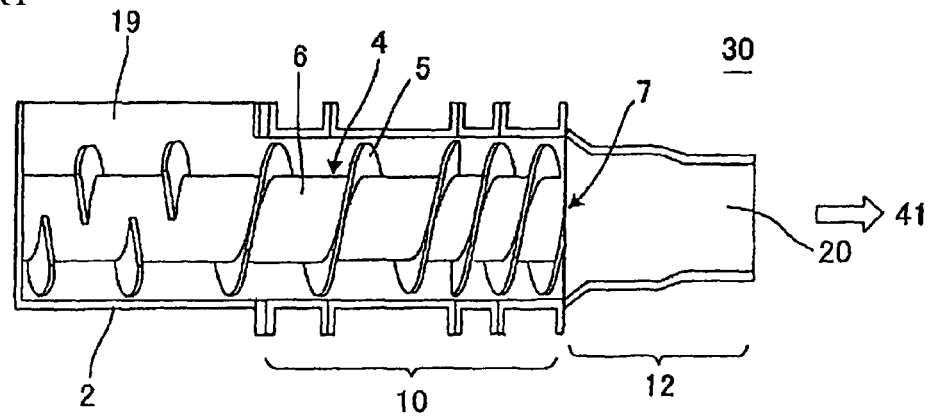
FIG.4 PRIOR ART
FIG. 4 is a schematic constitution diagram showing another example of the conventional clay kneader.

In the present invention, a columnar article is prepared by using a clay kneader 30. Hereinafter, a flow for preparing the columnar article from a clay including a ceramic material will be described with reference to FIGS. 1 and 5. FIG. 1 is a schematic constitution diagram showing one example of the clay kneader of the present invention. A kneaded clay formed by blending a ceramic material with a predetermined amount of a binder or the like and then kneading the material with a kneader or the like is introduced into a drum 2. The clay is kneaded by a screw 4 in the drum 2, and fed under pressure to an extrusion opening 20 while rotating.

Figure 5:
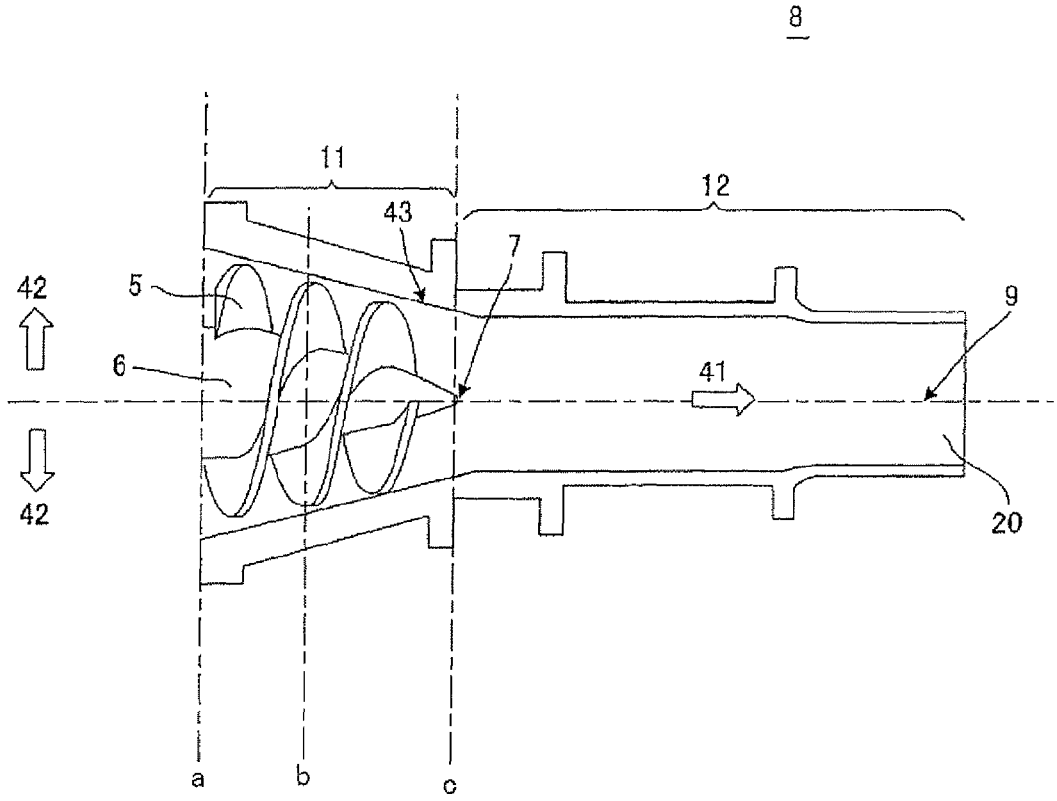
FIG. 5 is a schematic sectional view showing a distal end structure of the clay kneader of the present invention.
Figure 6:
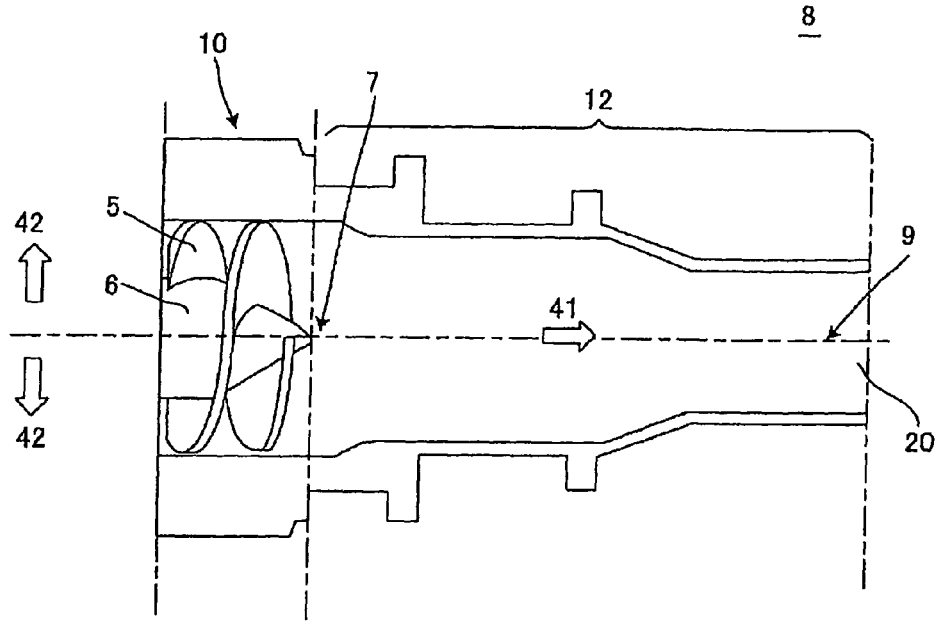
FIG.6 PRIOR ART
FIG. 6 is a schematic sectional view showing a distal end structure of the conventional clay kneader.
Figure 10:
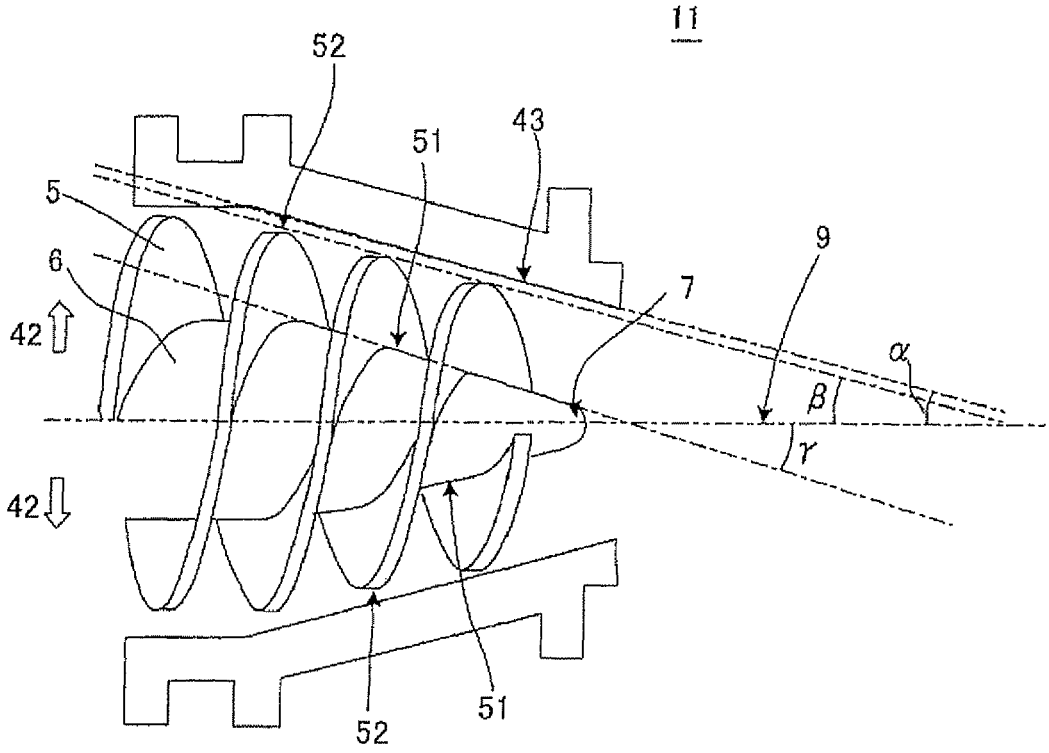
FIG. 10 is a schematic sectional view showing a flow controlling section of the clay kneader of the present invention.

FIG. 5 is a schematic sectional view showing a distal end structure of the clay kneader of the present invention. As shown in FIG. 5, a rotary shaft 6 has a distal end thinned in a tapered manner in a flow controlling section 11, and coincidentally the inner diameter of the drum 2 and the diameter of a rotating blade 5 also decrease and taper to keep the internal volume of the drum 2. The inner diameter of the drum 2 and the diameter of the rotating blade 5 can be changed in accordance with the tapered distal end shape of the rotary shaft 6, but as shown in FIG. 10, each of the fluctuation of an angle $\gamma$ of a tapered portion 51 of the distal end of the rotary shaft and the fluctuation of an angle $\beta$ of an outer peripheral portion 52 of the rotating blade based on an angle $\alpha$ of an inner wall 43 of the flow controlling section with respect to the direction of a rotary shaft center line 9 in the flow controlling section 11 is preferably in a range of 0 to 10°.

Figure 7A:
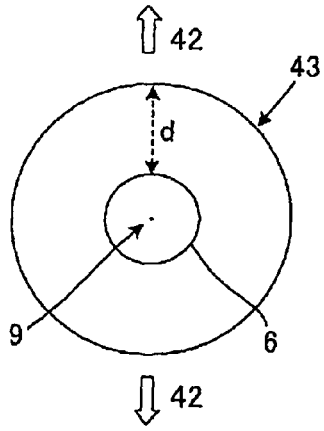
FIG. 7A is a schematic sectional view, for explaining a distance d between a drum inner wall and a rotary shaft, cut along a plane vertical to the rotary shaft, shown by a broken line a in FIG. 5.
Figure 7B:
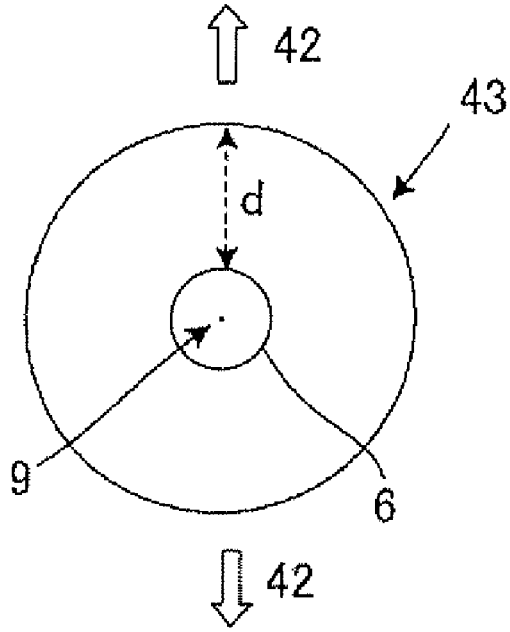
FIG. 7B is a schematic sectional view, for explaining the distance d between the drum inner wall and the rotary shaft, cut along a plane vertical to the rotary shaft, shown by a broken line b in FIG. 5.
Figure 7C:
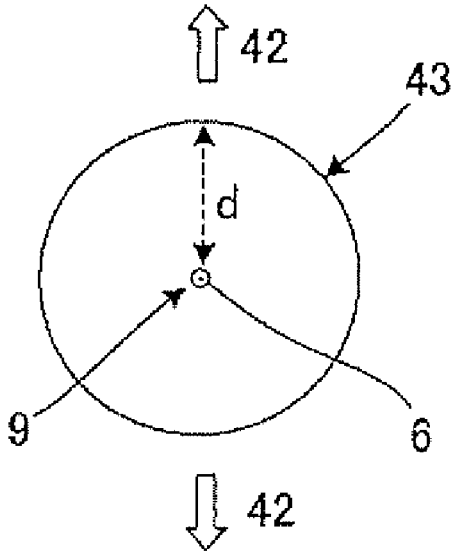
FIG. 7C is a schematic sectional view, for explaining the distance d between the drum inner wall and the rotary shaft, cut along a plane vertical to the rotary shaft, shown by a broken line c in FIG. 5.

The sectional shapes of the rotary shaft 6 and the flow controlling section inner wall 43 along planes provided vertically to the rotary shaft center line 9 of FIG. 5 and shown by broken lines a, b and c in the drawing are shown in FIGS. 7A, 7B and 7C, respectively. As shown in FIGS. 7A, 7B and 7C, respectively, it is preferable that a distance d between the rotary shaft 6 and the flow controlling section inner wall 43 does not fluctuate. If the distance fluctuates, the fluctuation is preferably in the above range of 0 to 40%. In consequence, the clay moving in the flow controlling section 11 can be formed into a columnar article having a desired diameter, the article being finally obtained while suppressing, as much as possible, the adverse influence of the curvature or the like of the flow pattern in the extrusion opening 20 direction due to a clay density difference.

Moreover, as shown in FIG. 5, the length of the flow controlling section 11 in the rotary shaft center line 9 direction is preferably in a range of 30 to 45 cm. At this time, the columnar article having the desired diameter can be obtained while suppressing the curvature of the flow pattern in an extrusion direction 41 in the flow controlling section 11.

Furthermore, as shown in FIG. 5, the ratio of the diameter of an inner wall of the flow controlling section 11 in the end thereof on the extrusion opening 20 side with respect to the diameter of the inner wall of the flow controlling section in the end thereof on a supply opening 19 side is preferably in a range of 60 to 75%. At this time, the columnar article having the desired diameter can be obtained while suppressing the curvature of the flow pattern in the extrusion direction 41 in the flow controlling section 11.

EXAMPLE

Figure 8:
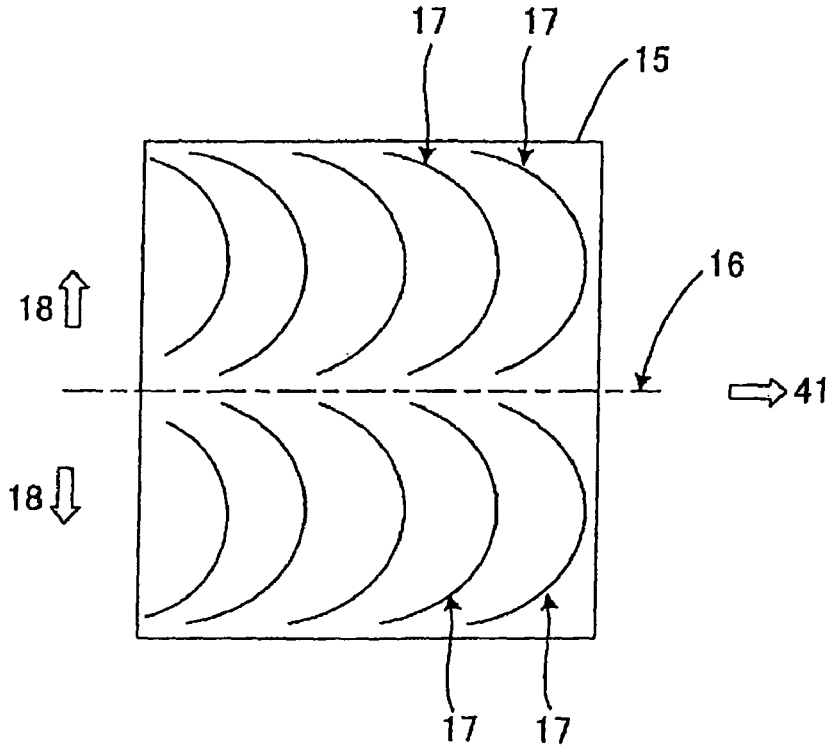
FIG.8 PRIOR ART
FIG. 8 is a schematic sectional view showing a flow pattern in a columnar article obtained by using the conventional clay kneader.
Figure 9:
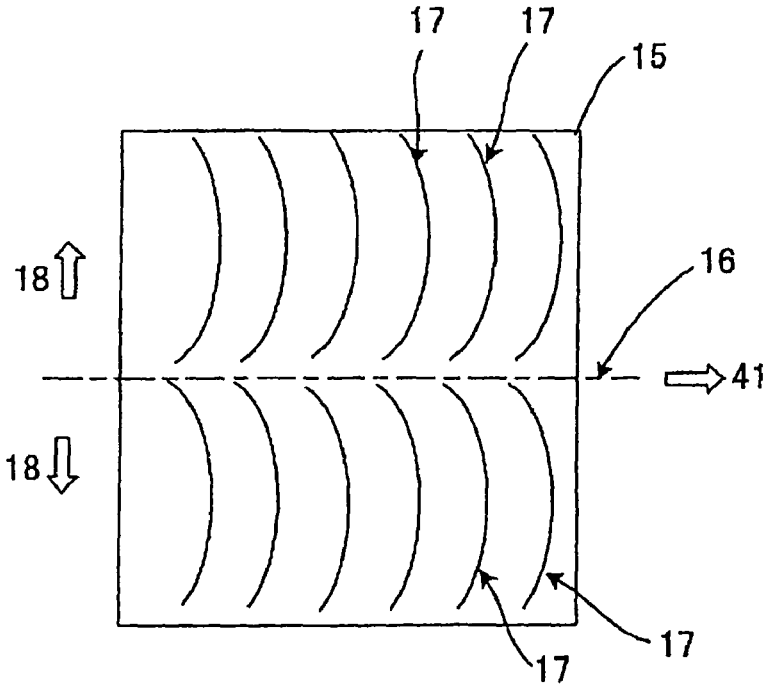
FIG. 9 is a schematic sectional view showing a flow pattern in a columnar article obtained by using the clay kneader of the present embodiment.

Here, a screw rotation speed was set at 2 rpm as an operating condition of a clay kneader, and a clay was kneaded and extruded to obtain a columnar article. FIGS. 8 and 9 are schematic diagrams showing sectional shapes of columnar articles obtained by using a conventional clay kneader and a clay kneader of the present embodiment, respectively.

As shown in FIG. 8, a columnar article 15 obtained by using the conventional clay kneader is provided with a flow pattern 17, and further the flow pattern 17 noticeably curves in an extrusion direction 41. On the other hand, as shown in FIG. 9, a columnar article 15 obtained by using the clay kneader of the present embodiment is provided with a flow pattern 17, but the curvature of the flow pattern in the extrusion direction 41 is suppressed as compared with FIG. 8.

INDUSTRIAL APPLICABILITY

A clay kneader of the present invention can preferably be applied to the preparation of a columnar article including a ceramic material, the columnar article being used in forming a ceramic honeycomb structure. Moreover, the curvature of the flow pattern of a clay occurring in an extrusion direction and causing a forming failure in a drum is suppressed as much as possible, and a columnar article which is excellent in forming properties can be prepared, so that the present invention is preferably applicable to not only the forming of the ceramic honeycomb structure but also the preparation of another columnar article for the forming.

The invention claimed is:

1. A clay kneader comprising a drum including:

a supply opening through which a clay including a ceramic material flows into the clay kneader;

a screw having a rotary shaft and a helical rotating blade provided along the rotary shaft and configured to knead the clay which has flowed into the clay kneader by the rotation of the rotating blade;

an extrusion opening from which the clay is extruded as a columnar article;

a pressure raising section located between the supply opening and the extrusion opening;

an extrusion section having an inner diameter smaller than a diameter of the pressure raising section, the extrusion section being located between the pressure raising section and the extrusion opening;

and a flow controlling section located between the pressure raising section and the extrusion section, an inner diameter of the flow controlling section gradually decreasing from a portion of the flow controlling section that is closest to the pressure raising section toward a portion of the flow controlling section that is closest to the extrusion section, wherein an inner diameter of a portion of the pressure raising section closest to the flow controlling section is equal to the inner diameter of the portion of the flow controlling section that is closest to the pressure raising section and an inner diameter of a portion of the extrusion section that is closest to the flow controlling section is equal to the inner diameter of the portion of the flow controlling section that is closest to the extrusion section, wherein the rotary shaft has a diameter in the flow controlling section, which gradually decreases toward the extrusion opening and includes a rotary shaft end section around a boundary between the flow controlling section and the extrusion section, wherein the rotating blade is formed from at least the inside of the pressure raising section to a vicinity of the rotary shaft end section, wherein a ratio of the inner diameter of the portion of the flow controlling section that is closest to the extrusion section to the inner diameter of the portion of the flow controlling section that is closest to the supply opening is in a range of 60 to 75%, and wherein an inner wall of the flow controlling section tapers at a first angle with respect to a centerline of the rotary shaft, a tapered portion of a distal end of the rotary shaft tapers at a second angle with respect to the centerline of the rotary shaft, a plane that is tangential to outer peripheral portions of the rotating blade within the flow controlling section forms a third angle with the centerline of the rotary shaft, a difference of the second angle from the first angle is in a range of 0 to 10°, and a difference of the third angle from the first angle is in a range of 0 to 10°.

2. The clay kneader according to claim 1, wherein a length of the flow controlling section in a direction of a center line of the rotary shaft is in a range of 30 to 45 cm.

* * * * *